US010864754B2

(12) United States Patent
Sunaoshi

(10) Patent No.: US 10,864,754 B2
(45) Date of Patent: Dec. 15, 2020

(54) RECORDING MEDIUM SUPPORT DEVICE AND IMAGE FORMING APPARATUS

(71) Applicant: Masayuki Sunaoshi, Ibaraki (JP)

(72) Inventor: Masayuki Sunaoshi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/351,582

(22) Filed: Mar. 13, 2019

(65) Prior Publication Data

US 2019/0283461 A1 Sep. 19, 2019

(30) Foreign Application Priority Data

Mar. 16, 2018 (JP) ..... 2018-049588

(51) Int. Cl.
*B41J 11/00* (2006.01)
*B41J 13/22* (2006.01)

(52) U.S. Cl.
CPC ..... *B41J 11/002* (2013.01); *B41J 11/0085* (2013.01); *B41J 13/226* (2013.01)

(58) Field of Classification Search
CPC ..... B41J 11/002; B41J 11/007; B41J 11/0085; B41J 11/02
See application file for complete search history.

(56) References Cited

U.S. PATENT DOCUMENTS 4,685,557 A * 8/1987 Roinestad ..... B65G 23/06 198/834
6,460,990 B2 * 10/2002 Yraceburu ..... B41J 11/002 347/102
9,180,694 B2 * 11/2015 Yoshino ..... B41J 11/06
2005/0092200 A1 * 5/2005 Beauchamp ..... B41J 13/226 101/409
2012/0162334 A1 * 6/2012 Sasaki ..... B41J 11/002 347/102
2013/0016162 A1 1/2013 Yasu et al.
2015/0210090 A1 * 7/2015 Sasaki ..... B41J 11/06 347/102
2016/0075150 A1 3/2016 Sunaoshi
2016/0075157 A1 3/2016 Morinaga et al.
2016/0130110 A1 5/2016 Honda et al.
2017/0217719 A1 8/2017 Honda
2017/0368849 A1 12/2017 Masunaga
2018/0178554 A1 * 6/2018 Washizawa ..... B41J 11/06
(Continued)

FOREIGN PATENT DOCUMENTS

JP 2009-090640 4/2009
JP 2009-274399 11/2009
(Continued)

*Primary Examiner* — John Zimmermann
(74) *Attorney, Agent, or Firm* — Obion, McClelland, Maier & Neustadt, L.L.P.

(57) ABSTRACT

A recording medium support device includes a recording medium support, a holder, and a support heater. The recording medium support supports a recording medium on which liquid is discharged. The holder holds the recording medium support, the holder including an air chamber and a duct. The support heater heats the recording medium support. A linear expansion coefficient of a bottom surface of the air chamber or a bottom surface of the duct away from the recording medium support is larger than a linear expansion coefficient of the recording medium support.

6 Claims, 6 Drawing Sheets

(56) References Cited

U.S. PATENT DOCUMENTS

| | | | |
|---|---|---|---|
| 2018/0236794 | A1 | 8/2018 | Mizuno et al. |
| 2018/0257902 | A1 | 9/2018 | Honda |
| 2018/0270366 | A1 | 9/2018 | Sunaoshi et al. |
| 2018/0272694 | A1 | 9/2018 | Gohda et al. |

FOREIGN PATENT DOCUMENTS

| | | |
|---|---|---|
| JP | 2012-061813 | 3/2012 |
| JP | 2013-018252 | 1/2013 |
| JP | 2013-159059 | 8/2013 |
| JP | 2017-105039 | 6/2017 |

* cited by examiner

RECORDING MEDIUM SUPPORT DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-049588, filed on Mar. 16, 2018, in the Japan Patent Office, the entire disclosure of which is incorporated by reference herein.

BACKGROUND

Technical Field

The present disclosure relates to a recording medium support device and an image forming apparatus.

Related Art

An image forming apparatus has been known that discharges liquid to a recording medium such as paper as liquid droplets to form an image on the recording medium. Some image forming apparatuses can use a long recording medium. In a case where a long recording medium is used, a recording medium support device for supporting the recording medium in a state where a landing position of the liquid droplets is adjusted is included.

In the image forming apparatus including the recording medium support device, in a state where the recording medium is conveyed from an upstream side in the conveyance direction to a recording medium support (platen) for supporting the recording medium and is temporarily stopped, for example, liquid ink is discharged from a liquid head to the recording medium to form an image. The recording medium on which an image has been formed is conveyed on the platen to the downstream side in the conveyance direction. To adjust permeability and fixability of liquid droplets landed on the recording medium to the recording medium, the recording medium supported on the platen is heated via the platen.

However, when the platen is heated, a surface for supporting the recording medium is deformed due to thermal expansion. When the surface of the platen is deformed, the deformation affects accuracy of the landing position of the liquid droplets discharged from the liquid discharge head and attached to the recording medium, and as a result, the deformation causes deterioration in the quality of result of image formation.

SUMMARY

In an aspect of the present disclosure, there is provided a recording medium support device that includes a recording medium support, a holder, and a support heater. The recording medium support supports a recording medium on which liquid is discharged. The holder holds the recording medium support, the holder including an air chamber and a duct. The support heater heats the recording medium support. A linear expansion coefficient of a bottom surface of the air chamber or a bottom surface of the duct away from the recording medium support is larger than a linear expansion coefficient of the recording medium support.

In another aspect of the present disclosure, there is provided an image forming apparatus that includes the recording medium support device, a liquid discharge device, and a conveyor. The liquid discharge device discharges liquid toward the recording medium supported by the recording medium support of the recording medium support device. The conveyor conveys the recording medium to a position opposed to the liquid discharge device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
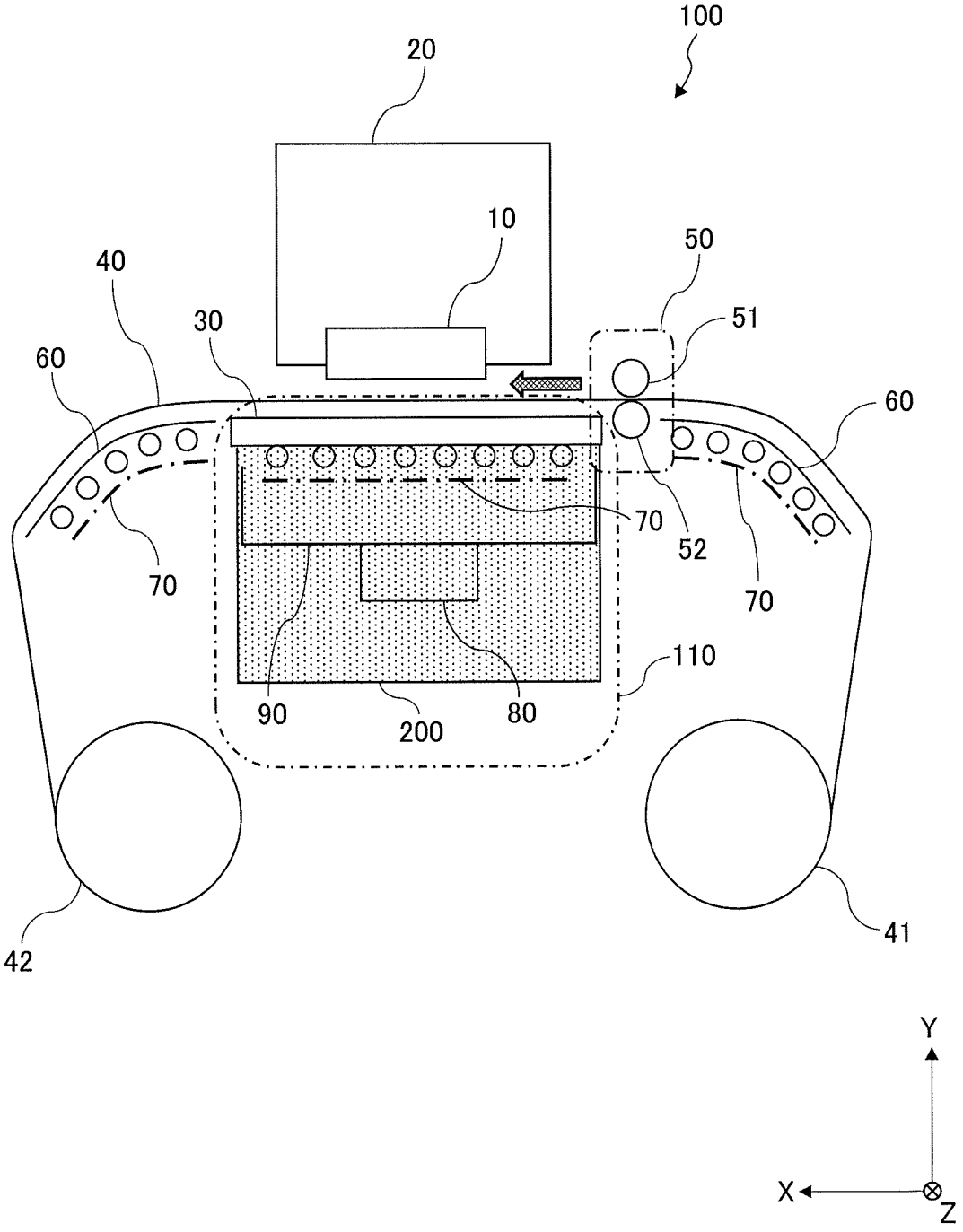
FIG. 1 is a schematic view of an overall structure of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, a recording medium support device and an image forming apparatus according to embodiments of the present disclosure will be described with reference to the drawings. In the recording medium support device according to an embodiment of the present disclosure, a holder which holds a recording medium support at a predetermined position has a duct-like shape so as to exhaust heat of the holder. The recording medium support device has a configuration in which a member having a large linear expansion coefficient is provided at a position away from the recording medium support. The recording medium support device tends to deform due to a difference in thermal expansion caused by forming a high temperature portion and a low temperature portion in the holder having contact with the recording medium support. However, the recording medium support device has a structure which has an effect for reducing the deformation. This structure can reduce the deformation of the holder and can suppress an effect on flatness of the recording medium support from the deformation due to the thermal expansion.

Embodiment of Image Forming Apparatus

FIG. 1 is a schematic configuration view of an example of a configuration of an inkjet printer 100 according to the present embodiment. The inkjet printer 100 includes a print head 10, a carriage 20, a platen 30, and a conveyor 50. In FIG. 1, a rectangle (indicated by alternate long and short dash line) including the platen 30 is a platen device 200 which is the recording medium support device according to the present embodiment. First, an overall configuration of the inkjet printer 100 will be described.

The print head 10 is a liquid discharge head for discharging liquid to a medium 40 which is a recording medium.

The carriage 20 moves the print head 10 above the platen 30 which is the recording medium support in the X direction in FIG. 1.

The platen 30 is a main part of the platen device 200 and includes a top face which maintains the medium 40 with accurate positional relationship relative to the print head 10 at a position where liquid is discharged from the print head 10 to the medium 40. The top face of the platen 30 is formed with highly accurate flatness. A platen holder 220 for holding the platen 30 at a predetermined position is provided on the opposite side of the top face of the platen 30.

The conveyor 50 conveys the medium 40 at a predetermined speed and timing so that the medium 40 passes through the top face of the platen 30. Furthermore, the conveyor 50 sandwiches the medium 40 between a feed roller 51 and a press roller 52 and rotates the feed roller 51 so as to move the medium 40 in the X direction. The medium 40 is conveyed according to the rotation of the feed roller 51.

For example, the medium 40 is paper. However, the medium 40 is not limited to this, and various media can be used as the medium 40.

In a conveyance path 60 which connects the platen 30, an upstream side, and a downstream side of the platen 30 in a conveyance direction, a heater 70 for drying the liquid attached to the conveyed medium 40 is arranged. The heater 70 is arranged on the opposite side of the print head 10 across the medium 40 in the Y direction. That is, the heater 70 heats the medium 40 from a rear surface side of a support surface for supporting the medium 40 which is the top face of the platen 30. As a result, the surface of the medium 40 to which the liquid has been attached is heated from the opposite surface (back surface) and dried.

It is only necessary for the heater 70 to have a structure for heating the medium 40 on the conveyance path 60. Therefore, the system and the detailed structure of the heater 70 can be appropriately selected from among various systems. For example, an electric heater using ceramics or nichrome wire and the like can be used. The heater 70 configures a support heater.

In the top face (surface where medium 40 is placed) of the platen 30, suction holes for attracting the medium by a negative pressure are provided. As a negative pressure generator, a fan 80 and an air chamber 90 for holding the negative pressure are provided on the opposite side of the top face of the platen 30.

The negative pressure generated by the fan 80 and the air chamber 90 prevents the medium 40 conveyed on the platen 30 from floating. The platen holder 220 has openings in the X direction and forms a duct for flowing air suctioned by the fan 80 in the Y direction and exhausting the air.

The inkjet printer 100 may further include a rewinder 41 and a winder 42. The rewinder 41 is provided on the upstream side of the platen 30 in the conveyance direction, and rewinds the medium 40 which is wound in a roll-like shape and feeds the medium 40 to the platen 30. The winder 42 is provided on the downstream side of the platen 30 in the conveyance direction and winds the medium 40, which is fed forward from the platen 30 and on which an image has been formed, in a roll-like shape.

Description of Comparative Example

Figure 2A:
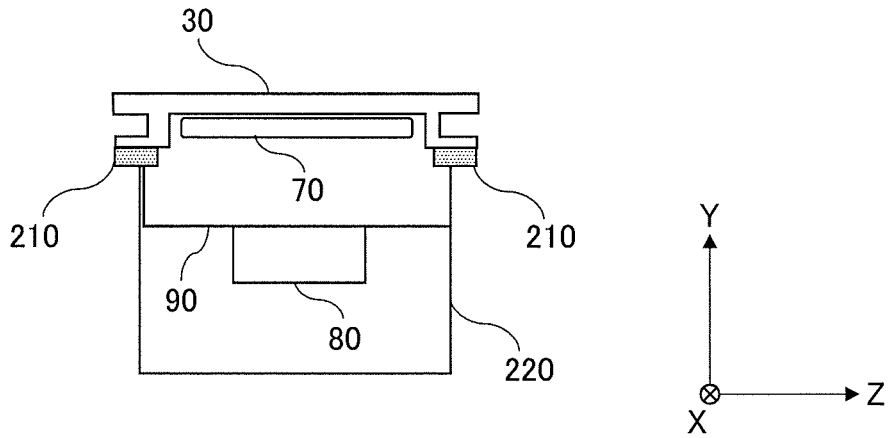
FIGS. 2A and 2B are explanatory views of a recording medium support device according to a comparative example of the present disclosure.
Figure 2B:
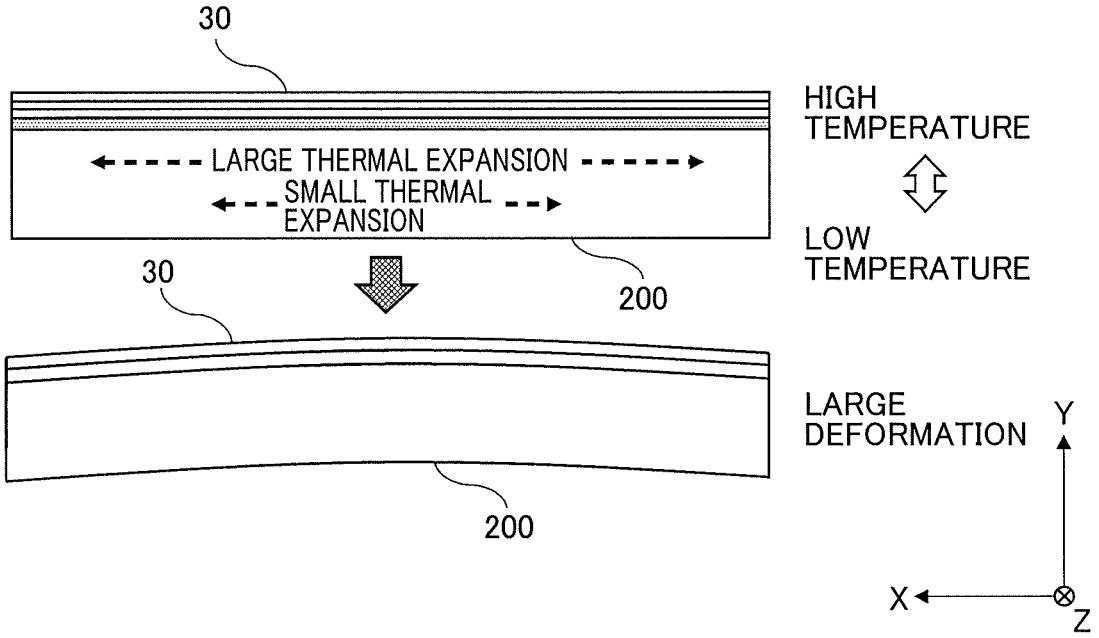

Here, to explain the features of the recording medium support device according to the present embodiment, a configuration of a comparative example will be described first. FIGS. 2A and 2B illustrate an example in which a characteristic configuration is removed from the platen device 200 according to the present embodiment.

FIG. 2A is a view of the platen device 200 illustrated in FIG. 1 as viewed from the side, and FIG. 2B is a view of the platen device 200 as viewed from the upstream side of the medium 40 in the conveyance direction.

As illustrated in FIG. 2A, the platen device 200 includes the platen 30, the fan 80 for generating the negative pressure, and the air chamber 90 for holding the negative pressure. When the fan 80 is operated, the negative pressure is applied to a hole formed in the top face which is the surface of the platen 30 where the medium 40 is placed. With this negative pressure, the medium 40 placed on the top face is suctioned by the platen 30. This suction action prevents the medium from floating in an image forming region.

As illustrated in FIG. 2A, the platen holder 220 functions as a duct for exhausting wind generated by the fan 80 attached to a bottom surface of the air chamber 90 and holds the platen 30 at the predetermined position.

The platen holder 220 is fixed to the platen 30 with a sealing member 210 so as to surround an entire peripheral side surface a bonding portion between the platen 30 and the platen holder 220. The heater 70 is arranged on the back surface (surface in −Y direction) of the platen 30. Therefore, the heater 70 also heats the platen 30. A configuration is employed in which a sheet metal biased by a spring force surrounds the bonding portion between the platen 30 and the platen holder 220 so as not to deform the entire platen device 200 including the platen holder 220 due to the thermal expansion caused by an increase in a temperature of the platen 30. With this configuration, the platen 30 slips by the thermal expansion. As a result, the deformation of the platen 30 due to the thermal expansion is suppressed to some extent.

When the temperature of the platen 30 is increased by the heater 70, the heat is transferred to the platen holder 220, and the temperature of the platen holder 220 is increased. Regarding the temperature of the platen holder 220, a temperature of a portion having contact with the platen 30 is high, and a temperature becomes lower as separated from the high-temperature portion. That is, due to the heat from the platen 30, the temperatures of the platen holder 220 vary depending on the portion. The difference in the temperatures occurs in a height direction (Y direction) of the platen holder 220.

FIG. 2B is a view of the platen holder 220 as viewed from the side and illustrates the deformation caused by the thermal expansion. The difference in the temperatures in the platen holder 220 occurs in the height direction of the platen holder 220 as illustrated in FIG. 2B. Therefore, a portion of the platen holder 220 closer to the platen 30 has larger thermal expansion, and thermal expansion of the side of the platen holder 220 away from the platen 30 is smaller. Then, in general, the deformation as illustrated in FIG. 2B occurs. That is, the platen 30 is deformed to have a convex shape in a center portion in the X direction. Such deformation causes reduction in the flatness of the top face of the platen 30.

When the flatness of the top face of the platen 30 is reduced, a slight difference in a distance occurs between the print head 10 and the platen 30. With this difference, a landing position and a landing state of the liquid discharged from the print head 10 to the medium 40 become different from the landing position and the landing state which are ideally adjusted. In this way, if the positional relationship between the print head 10 and the platen 30 collapses, the collapse deteriorates the quality of image formation.

Embodiment of Recording Medium Support Device

Next, a platen device 200 as the recording medium support device according to an embodiment of the present disclosure will be described with reference to FIGS. 3A and 3B. Components of the platen device 200 illustrated in FIGS. 2A and 2B as the comparative example are respectively denoted with the same reference numerals.

Figure 3A:
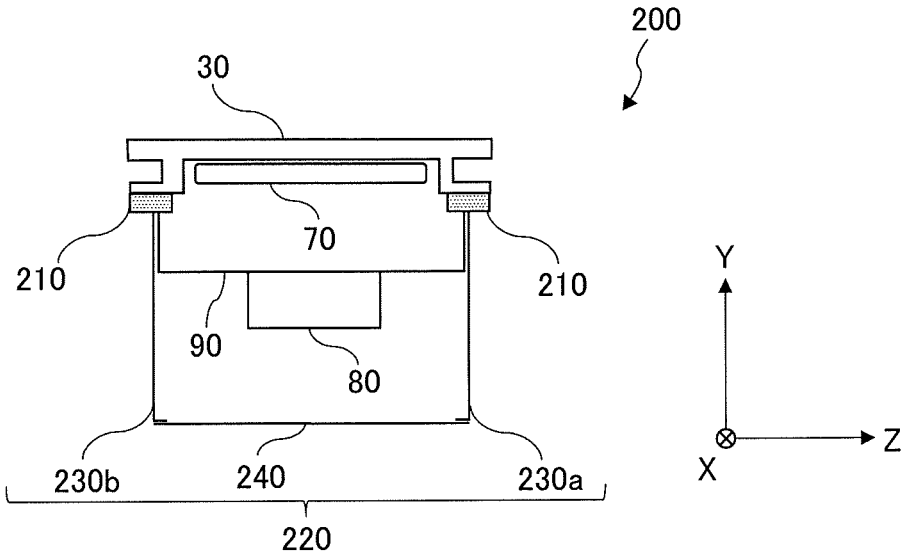
FIGS. 3A and 3B are schematic views a recording medium support device according to an embodiment of the present disclosure.
Figure 3B:
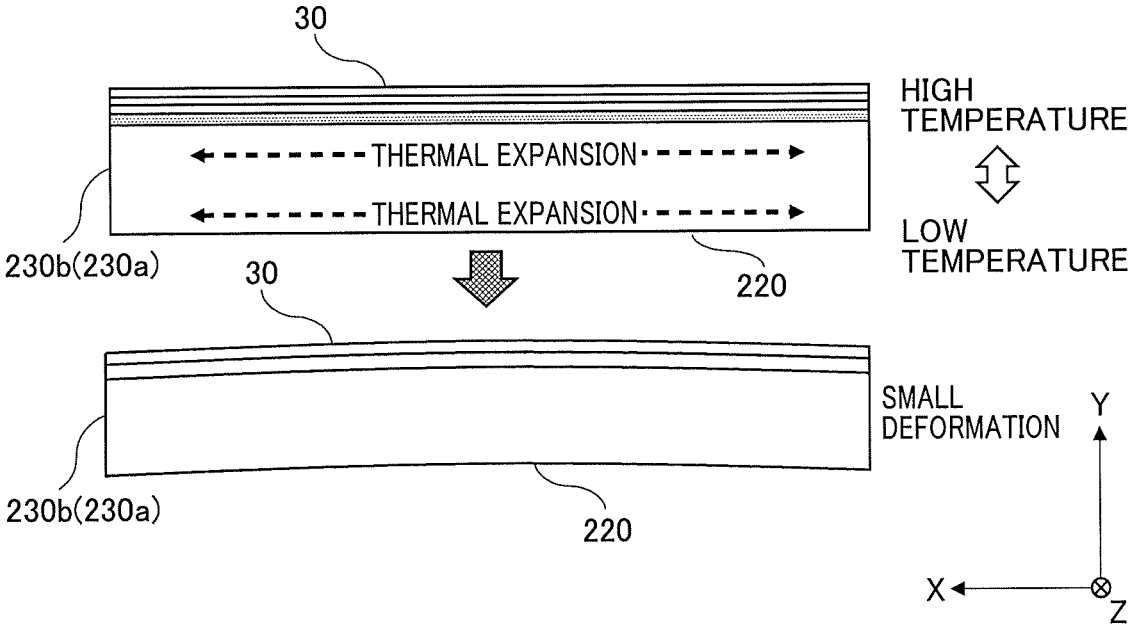

As illustrated in FIGS. 3A and 3B, the platen device 200 includes a platen 30 and a platen holder 220 which is a holding structural member for holding the platen 30. The platen holder 220 according to the present embodiment includes a duct side surfaces 230*b* and 230*a* forming a duct on the side of the back surface of the platen 30 and a duct bottom surface 240 which is a bottom plate provided on the lower surface side of the duct side surfaces 230*b* and 230*a*.

An air chamber 90 is formed on the side of the back surface of the platen 30, and a fan 80 for operating to exhaust air in the air chamber 90 is formed outside of the lower surface of the air chamber 90. The platen holder 220 has a structure that also acts as a duct member for guiding exhaust air exhausted by the fan 80.

Therefore, the platen holder 220 according to the present embodiment is formed in a box-like shape in which the duct side surfaces 230*b* and 230*a*, the duct bottom surface 240, and the air chamber 90 are integrally formed. The side surface of the platen holder 220 in the X direction may be opened.

The platen holder 220 is fixed to the platen 30. To fix the platen holder 220 to the platen 30, a sealing member 210 is used to surround an entire peripheral side surface of a bonding portion so that the platen holder 220 is not deformed due to an influence of thermal expansion of the platen 30.

A configuration is employed in which a sheet metal biased by a spring force surrounds the bonding portion between the platen 30 and the platen holder 220 so as not to deform the entire platen device 200 including the platen holder 220 due to the thermal expansion caused by an increase in a temperature of the platen 30. With this configuration, the platen 30 slips by the thermal expansion.

For the duct bottom surface 240 of the platen holder 220, a member having a larger linear expansion coefficient than linear expansion coefficients of the air chamber 90 and the duct side surfaces 230*b* and 230*a* is used. For example, the air chamber 90 and the duct side surfaces 230*b* and 230*a* are formed of iron, and the duct bottom surface 240 is formed of stainless and the like. The duct bottom surface 240 is fastened to the duct side surfaces 230*b* and 230*a* with fastening members such as rivets.

According to the platen holder 220 according to the present embodiment having the above configuration, as illustrated in FIG. 3B, even when a different in temperatures in a height direction occurs, a difference in the thermal expansions can be reduced by the difference in the linear expansion coefficients. As a result, deformation of the platen holder 220, that is, deformation of the platen 30 can be reduced.

Furthermore, in the platen device 200 according to the present embodiment, the fan 80 for forming a negative pressure is formed to constantly operate except for a time when the fan 80 is in a sleep mode. With this configuration, exhausted heat from the fan 80 reduces the difference in the temperatures in the platen holder 220. Then, the deformation of the platen holder 220 at the time when the heater 70 starts heating can be minimized.

The configuration of the platen holder 220 is not limited to the above, and for example, when a material having a large linear expansion coefficient is arranged in the bottom surface of the air chamber 90, a similar effect can be obtained.

Figure 4:
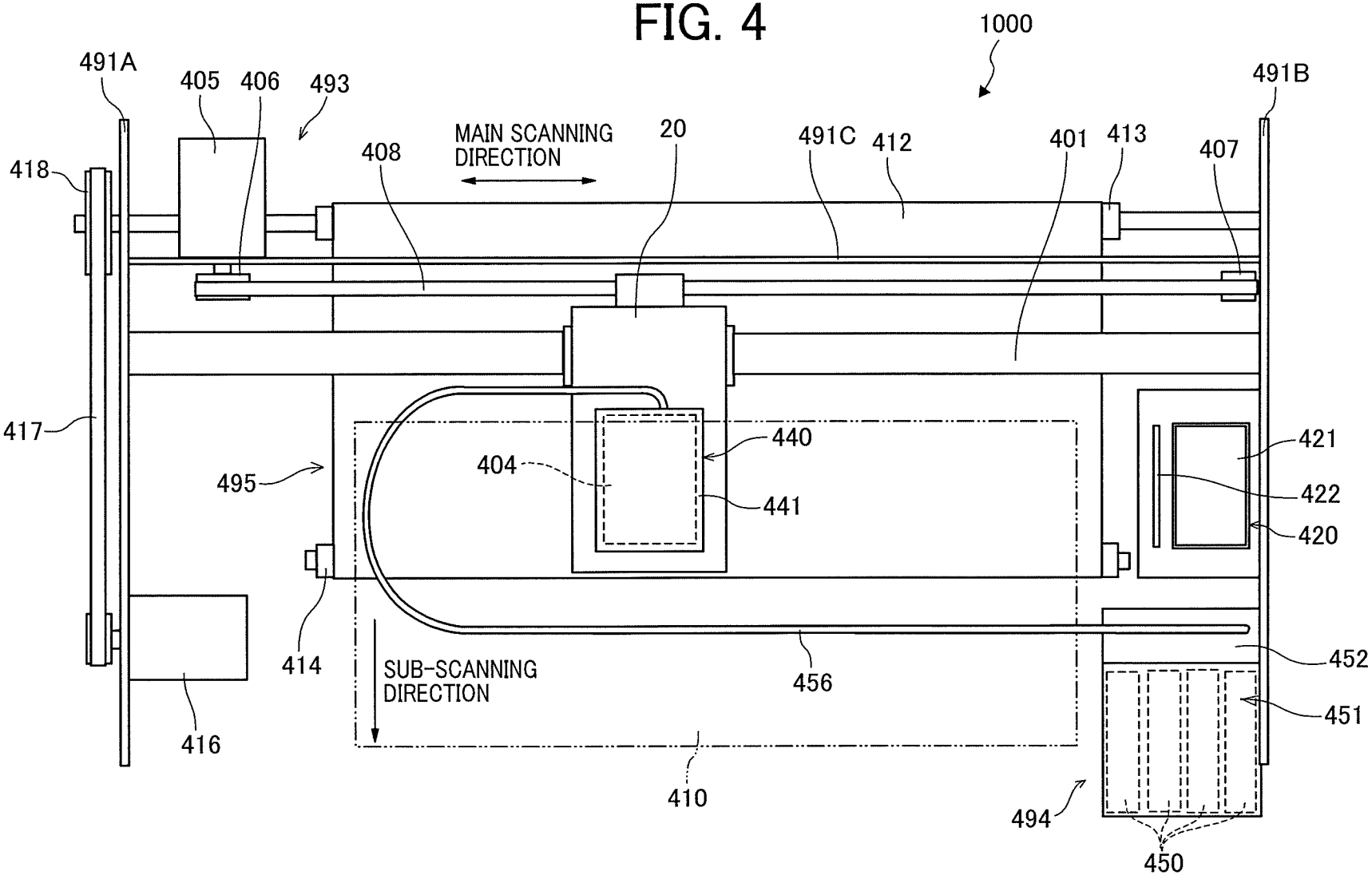
FIG. 4 is an explanatory plan view of an example of a main part of a liquid discharge apparatus according to an embodiment of the present disclosure.
Figure 5:
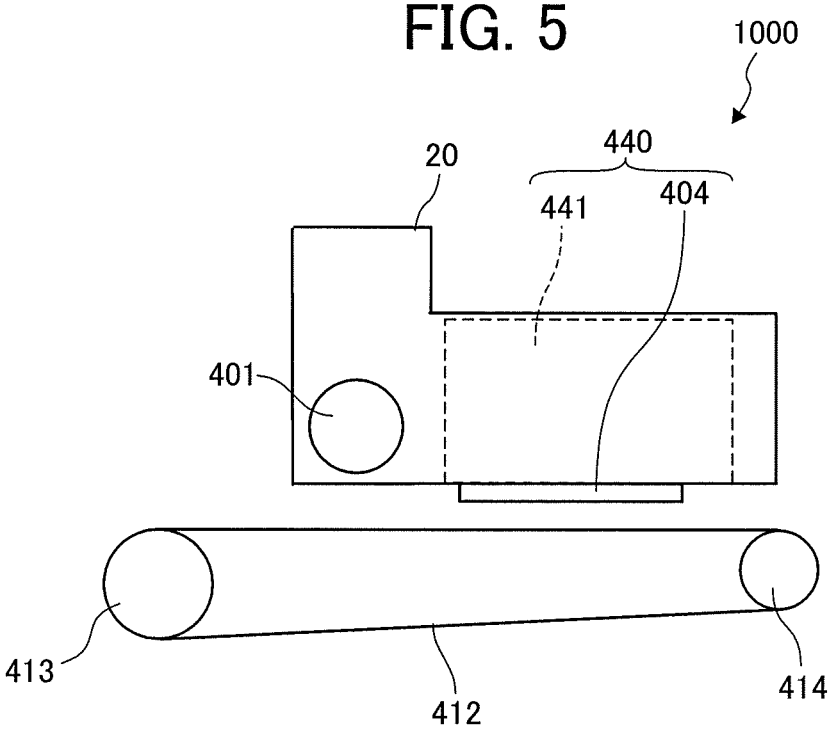
FIG. 5 is an explanatory side view of another example of a main part of the liquid discharge apparatus according to an embodiment of the present disclosure.

Next, a "liquid discharge apparatus" which is an image forming apparatus according to an embodiment of the present disclosure will be described with reference to FIGS. 4 and 5. FIG. 4 is an explanatory plan view of a main part of a liquid discharge apparatus 1000 according to the present embodiment. FIG. 5 is an explanatory side view of the main part of the liquid discharge apparatus 1000.

As the liquid discharge apparatus 1000, a serial type apparatus is exemplified. In the apparatus, a main scanning movement mechanism 493 reciprocates a carriage 20 in a main scanning direction. The main scanning movement mechanism 493 includes a guide member 401, a main scanning motor 405, a timing belt 408, and the like. The guide member 401 is stretched between left and right side plates 491A and 491B and movably holds the carriage 20. The main scanning motor 405 reciprocates the carriage 20 in the main scanning direction via the timing belt 408 stretched between a driving pulley 406 and a driven pulley 407.

The carriage 20 includes a liquid discharge device 440, in which a liquid discharge head 404 having a damper structure and a head tank 441 are integrated, used in the present embodiment. The liquid discharge device 440 corresponds to the print head 10 according to the embodiment of the recording medium support device.

The liquid discharge head 404 of the liquid discharge device 440 discharges liquid of each color, for example, yellow (Y), cyan (C), magenta (M), and black (K). In the liquid discharge head 404, a nozzle line including a plurality of nozzles is arranged in a sub-scanning direction perpendicular to the main scanning direction, and the liquid discharge head 404 is attached so as to discharge the liquid downward.

A supply mechanism 494 for supplying liquid stored outside the liquid discharge head 404 to the liquid discharge head 404 supplies liquid stored in a liquid cartridge 450 to the head tank 441.

The supply mechanism 494 includes a cartridge holder 451 which is a filling unit to which the liquid cartridge 450 is attached, a tube 456, a liquid feed unit 452 including a liquid feed pump, and the like. The liquid cartridge 450 is detachably attached to the cartridge holder 451. The liquid feed unit 452 feeds liquid from the liquid cartridge 450 to the head tank 441 via the tube 456.

The liquid discharge apparatus 1000 includes a conveyance mechanism 495 for conveying a paper sheet 410. The conveyance mechanism 495 includes a conveyance belt 412 which is a conveyor and a sub scanning motor 416 for driving the conveyance belt 412.

The conveyance belt 412 attracts the paper sheet 410 and conveys the paper sheet 410 at a position facing the liquid discharge head 404. The conveyance belt 412 is an endless belt and is stretched between a conveyance roller 413 and a tension roller 414. The paper sheet 410 can be attracted by electrostatic attraction or air suction. Furthermore, the sub scanning motor 416 rotates and drives the conveyance roller 413 via a timing belt 417 and a timing pulley 418 so that the conveyance belt 412 rotates and moves in the sub-scanning direction. In addition, on one side of the carriage 20 in the main scanning direction, a maintenance and recovery mechanism 420 which maintains and recovers the liquid discharge head 404 is arranged on the side of the conveyance belt 412.

The maintenance and recovery mechanism 420 includes, for example, a cap member 421 which caps a nozzle surface (surface where nozzle is formed) of the liquid discharge head 404 and a wiper member 422 which wipes the nozzle surface.

The main scanning movement mechanism 493, the supply mechanism 494, the maintenance and recovery mechanism 420, and the conveyance mechanism 495 are attached to a casing including the side plates 491A and 491B and a back plate 491C.

In the liquid discharge apparatus 1000 having the above configuration, the paper sheet 410 is fed on the conveyance belt 412 and attracted, and conveyed in the sub-scanning direction by the rotation movement of the conveyance belt 412. Therefore, by driving the liquid discharge head 404 in response to an image signal while moving the carriage 20 in the main scanning direction, the liquid is discharged on the stopped paper sheet 410 to form an image. In this way, since the liquid discharge apparatus 1000 includes the liquid discharge head used in the present embodiment, high-quality images can be stably formed.

Figure 6:
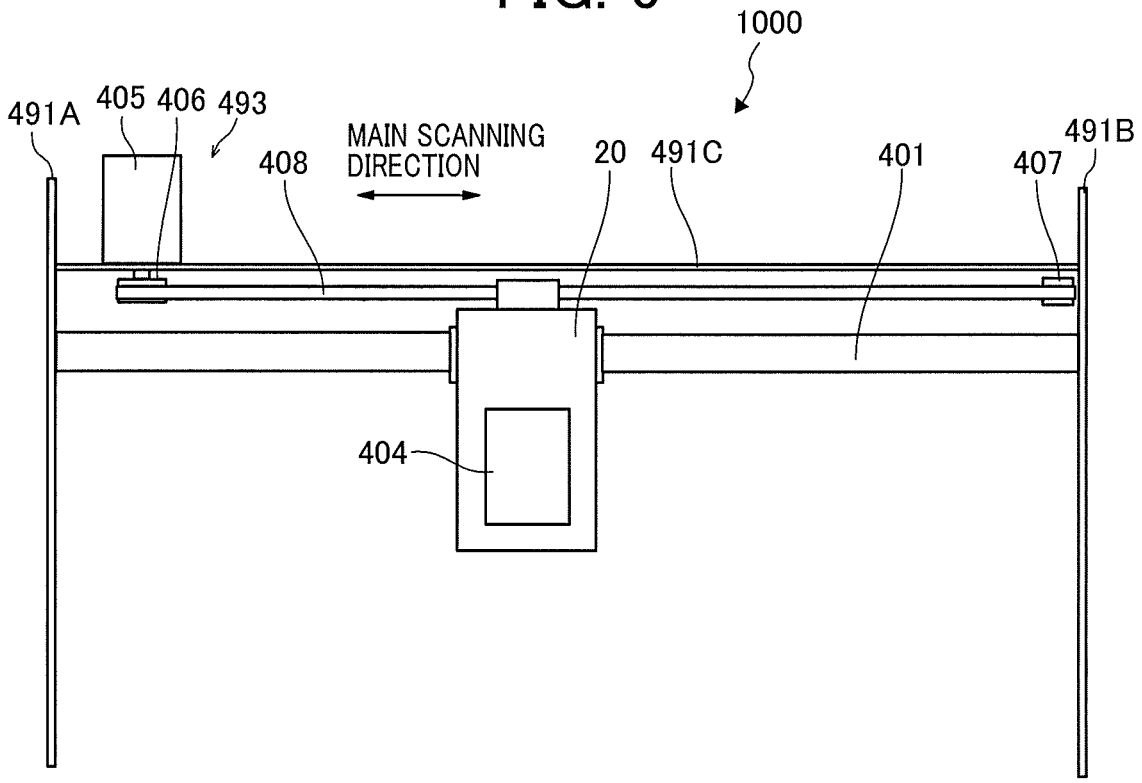
FIG. 6 is an explanatory plan view of an example of a main part of a liquid discharge device according to an embodiment of the present disclosure.

Next, an example of the liquid discharge device according to an embodiment of the present disclosure will be described with reference to FIG. 6. FIG. 6 is an explanatory plan view of a main part of the liquid discharge device.

The liquid discharge device according to the present embodiment includes the casing portion including the side plates 491A and 491B and the back plate 491C, the main scanning movement mechanism 493, the carriage 20, and the liquid discharge head 404 from among components included in the liquid discharge apparatus 1000 which is a liquid discharge device. A liquid discharge device can be formed in which at least one of the maintenance and recovery mechanism 420 and the supply mechanism 494 is further attached to, for example, the side plate 491B of the liquid discharge device.

Figure 7:
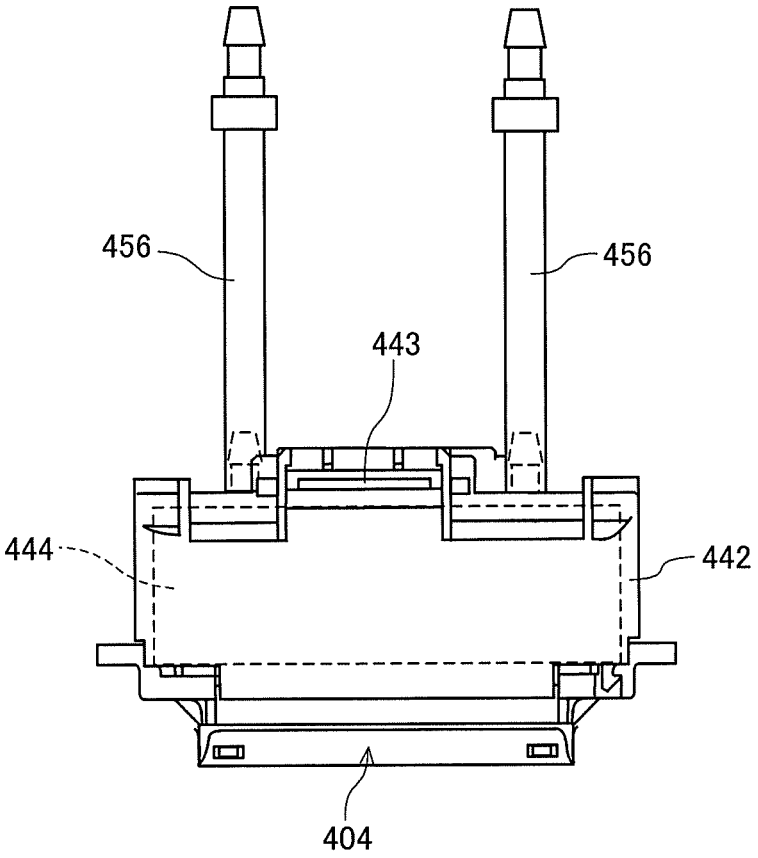
FIG. 7 is a front explanatory view of another example of the liquid discharge device according to an embodiment of the present disclosure.

Next, another example of the liquid discharge device that can be mounted on the liquid discharge apparatus according to an embodiment of the present disclosure will be described with reference to FIG. 7. FIG. 7 is a front explanatory view of the liquid discharge device according to the present embodiment.

The liquid discharge device includes the liquid discharge head 404 to which a channel component 444 is attached and the tube 456 coupled to the channel component 444. The channel component 444 is arranged in a cover 442. The head tank 441 can be included instead of the channel component 444. In addition, a connector 443 for electrically connecting with the liquid discharge head 404 is provided above the channel component 444.

In the present disclosure described above, the "liquid discharge apparatus" is an apparatus which includes the liquid discharge head or the liquid discharge device and drives the liquid discharge head and makes the liquid discharge head discharge the liquid. The liquid discharge apparatus includes not only an apparatus which can discharge liquid to an object to which liquid can be attached but also an apparatus for discharging liquid toward air and liquid.

Furthermore, the "liquid discharge apparatus" can include a device for feeding, conveying, and ejecting an object to which liquid can be attached, and in addition, can include a preprocessing device, a post-processing device, and the like.

For example, the "liquid discharge apparatus" includes an image forming apparatus which is an apparatus for discharging ink to form an image on a paper sheet and a three-dimensional fabrication apparatus for discharging fabrication liquid to a powder layer formed by processing powder in a layer shape so as to fabricate a three dimensional object.

Furthermore, the "liquid discharge apparatus" is not limited to an apparatus which visualizes an image having meaning such as letters and figures by the discharged liquid. For example, an apparatus which forms a pattern having no meaning and an apparatus which forms a three-dimensional image are included.

The "object to which the liquid can be attached" means an object to which liquid can be temporarily attached. The material of the "object to which liquid is attached" may be paper, thread, fiber, cloth, leather, metal, plastic, glass, wood, ceramics, and the like to which liquid can be temporarily attached.

Furthermore, the "liquid discharge apparatus" includes both of a serial type apparatus for moving the liquid discharge head and a line type apparatus which does not move the liquid discharge head, unless otherwise limited.

In addition, the "liquid discharge apparatus" includes a processing liquid applying apparatus which discharges processing liquid to a paper sheet to apply the processing liquid on the surface of the paper sheet for the purpose of improving the quality of the surface of the paper sheet. In addition, there is an injection granulation apparatus which injects composition liquid obtained by dispersing a raw material into solution via a nozzle and granulates fine particles of the raw material.

The "liquid discharge device" is a device in which functional components and mechanisms are integrated with the liquid discharge head and a group of components related to discharge of liquid. For example, the "liquid discharge device" includes a device obtained by combining at least one of the head tank, the carriage, the supply mechanism, the maintenance and recovery mechanism, and the main scanning movement mechanism with the liquid discharge head.

Here, the integration means, for example, to fix the liquid discharge head with the functional components and mechanisms by fastening, adhesion, engagement, and the like and to hold in a state where one of the components is held to be movable relative to the other component. Furthermore, the liquid discharge head and the functional components and mechanisms may be formed to be detachable from each other.

For example, as the liquid discharge device, as the liquid discharge device illustrated in FIG. 7, there is a device in which the liquid discharge head and the head tank are integrated. Furthermore, there is a device in which the liquid discharge head and the head tank are integrated with each other by being coupled with the tube and the like. Here, a device including a filter between the head tank and the liquid discharge head in the liquid discharge device can be added.

In addition, there is a liquid discharge device in which the liquid discharge head and the carriage are integrated with each other.

There is a liquid discharge device in which a guide member forming a part of a scanning movement mechanism movably holds the liquid discharge head and the scanning movement mechanism and the liquid discharge head are integrated with each other. As illustrated in FIG. 5, there is a liquid discharge device in which the liquid discharge head, the carriage, and the main scanning movement mechanism are integrated.

In addition, there is a liquid discharge device in which the cap member which is a part of the maintenance and recovery mechanism is fixed to the carriage to which the liquid discharge head is attached to integrate the liquid discharge head, the carriage, and the maintenance and recovery mechanism.

Furthermore, as the liquid discharge device, as illustrated in FIG. 5, there is a liquid discharge device in which the tube is coupled to the liquid discharge head to which the head tank or the channel component is attached to integrate the liquid discharge head with the supply mechanism.

It is assumed that the main scanning movement mechanism include a single guide member. It is assumed that the supply mechanism include a single tube and a single loading unit.

Furthermore, a pressure generator used for the "liquid discharge head" is not limited. For example, other than the piezoelectric actuator (may use laminated piezoelectric element) as described in the embodiment, a thermal actuator using an electrothermal transducer such as a heating resistor and an electrostatic actuator including a diaphragm and a counter electrode may be used.

Herein, it is assumed that image formation, recording, printing letters, copying, printing, fabricating, and the like be all synonymous.

Embodiments of the present disclosure are not limited to the embodiment described above, and can be variously modified without departing from the technical gist, and all technical matters included in the technical idea described in claims are included in the present invention. The embodiment illustrates a preferable example, and a person skilled in the art can make various modifications from the disclosed contents. These modifications are included in the technical scope described in the appended claims.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A recording medium support device, comprising:

a recording medium support to support a recording medium on which liquid is discharged;

a holder to hold the recording medium support, the holder being adhered and fixed to the recording medium support, and including an air chamber and a duct; and a support heater to heat the recording medium support, wherein a linear expansion coefficient of a bottom surface of the duct away from the recording medium support is larger than a linear expansion coefficient of the air chamber and a side surface of the duct.

2. The recording medium support device according to claim 1, further comprising:

a fan to generate a negative pressure between the recording medium support and the recording medium, wherein the fan constantly operates, and an air flow generated by the fan reduces a temperature difference from the holder at a start of heating the recording medium support.

3. The recording medium support device according to claim 1, wherein the support heater heats a support surface of the recording medium support that supports the recording medium, from a back surface of the recording medium support opposite the support surface.

4. An image forming apparatus comprising:

the recording medium support device according to claim 1;

a liquid discharge device to discharge liquid toward the recording medium supported by the recording medium support of the recording medium support device; and a conveyor to convey the recording medium to a position opposed to the liquid discharge device.

5. A recording medium support device, comprising:

a recording medium support to support a recording medium on which liquid is discharged;

a holder to hold the recording medium support, the holder including an air chamber and a duct, the air chamber and the duct disposed on a back surface of the recording medium support; and a support heater to heat the recording medium support, wherein a linear expansion coefficient of a bottom surface of the air chamber or a bottom surface of the duct away from the recording medium support is larger than a linear expansion coefficient of the air chamber and a side surface of the duct.

6. The recording medium support of claim 1, wherein the holder is fixed to the recording medium support with a sealing member.

* * * * *